United States Patent [19]

Linstromberg

[11] Patent Number: 5,060,486

[45] Date of Patent: Oct. 29, 1991

[54] THERMOSTAT CONTROL FOR PROVIDING MULTIPLE TEMPERATURE RANGES IN A SINGLE REFRIGERATION COMPARTMENT

[75] Inventor: William J. Linstromberg, Lincoln Township, Berrien County, Minn.

[73] Assignee: Whirlpool Corporation, Benton Harbor, Mich.

[21] Appl. No.: 27,397

[22] Filed: Mar. 18, 1987

[51] Int. Cl.[5] ..... F25B 49/00; H01H 37/12

[52] U.S. Cl. ..... 62/229; 62/326; 200/43.16; 337/323; 337/360

[58] Field of Search ..... 62/229, 326; 236/94, 236/47; 74/553, 526; 337/82, 2, 57, 94, 323, 360, 361, 392; 16/121, DIG. 18, DIG. 30; 200/43.16

[56] References Cited

U.S. PATENT DOCUMENTS

| | | | |
|---|---|---|---|
| 2,253,162 | 8/1941 | Ayers | 62/229 X |
| 2,322,714 | 6/1943 | Kalischer | 62/229 X |
| 2,426,001 | 8/1947 | Denault | 200/43.16 X |
| 4,249,155 | 2/1981 | Fitzgerald et al. | 337/360 |

*Primary Examiner*—Harry B. Tanner
*Attorney, Agent, or Firm*—Mason, Kolehmainen, Rathburn & Wyss

[57] ABSTRACT

A rotatable control for a broad range, temperature controlling thermostat for a refrigeration compartment of a refrigeration unit enables operation of the refrigeration unit in one of several different operational modes. For example, the refrigeration unit may be operated as a wine cooler or as a standard refrigerator or as a freezer. The control includes a control dial having four, integrally formed, spaced apart stops formed on an inner surface. A stop formed on a cover of the thermostat may be placed between a pair of adjacent stops formed on the control dial to prevent adjustment of the set-point temperature of the refrigeration compartment outside of the particular temperature range associated with the preselected operational mode of the refigeration unit. In order to change the operational mode of the refrigeration unit, the control dial is movable axially along a control shaft of the thermostat to enable the stops formed on the control dial to freely rotate past the stop formed on the cover of the thermostat. Thereafter, the stop formed on the cover of the thermostat may be aligned between a different adjacent pair of the stops formed on the control dial. If the control dial is then returned to its initial axial position along the length of the control shaft of the thermostat, the set-point temperature for the refrigeration compartment may be selected and confined between the high temperature and low temperature limits formed by the new pair of stops on the control dial.

31 Claims, 2 Drawing Sheets

10
11
12
42
44
50
52
56
58
60
62
64
66
68
70
72
74
76

THERMOSTAT CONTROL FOR PROVIDING MULTIPLE TEMPERATURE RANGES IN A SINGLE REFRIGERATION COMPARTMENT

BACKGROUND OF THE INVENTION

A. Field of the Invention

The present invention generally relates to refrigeration systems and, more particularly, to a thermostat control capable of providing multiple temperature ranges in a single refrigeration compartment.

B. Description of the Prior Art

Rotatable controls for controlling the operation of many different devices, including temperature controlling thermostats, are old and well-known in the prior art as exemplified by U.S. Pat. Nos. 1,017,224; 1,423,627; 1,689,236; 2,684,811; 3,019,667; 3,564,929; 3,690,287; 3,999,158; and 4,014,178. The '224 patent relates to a feed indicator for a valve that enables the valve to be opened a predetermined amount and prevents its opening beyond that predetermined amount. The '627 patent relates to an indicator and movable stop for a valve to control the flow of fuel to the burner of a stove. The '236 patent also discloses an indicator and adjustable stop for use in controlling the operation of a rotary valve. The '811 patent relates to a rotatably adjustable temperature regulating thermostat for cooking appliances and includes an axially movable, depressable button that automatically reduces the temperature setting of the control dial of the thermostat by a fixed amount, for example, by 75° F.

The '667 patent relates to a rotatable control knob for electronic equipment that includes a spring biased locking mechanism that is ineffective when the control knob is rotated from an "off" position to one of several "on" or energized positions; the mechanism, however, prevents the unintentional or accidental rotation of the control knob to the "off" position. The '929 patent relates to a mechanical arrangement for limiting the rotation of a shaft, for example, a rotary control shaft of a control mechanism for controlling the audio volume in a television or radio receiver. In the '929 patent, the control shaft includes an abutment that contacts an adjustable abutment to limit the rotation of the control shaft.

The '287 patent relates to a multiturn rotary switch in which a movable indicator is attached to an axially and rotatably movable control knob. The '158 patent relates to a range limiter for a thermostat, for example, a thermostat for controlling the temperature of a room, in which desired upper and lower temperature limits can be easily changed by the owner of a rented or leased facility but cannot be as easily changed by the occupant of that room. Finally, the '178 patent discloses a refrigerator having multiple refrigeration compartments and rotatable thermostat control dials for controlling the temperature within each of the multiple refrigeration compartments.

While many control schemes exist in the prior art for controlling the operation of diverse devices within desired ranges, a need exists for a single thermostat control capable of providing multiple, preferably non-overlapping, temperature ranges in a single refrigeration compartment to thereby enable a refrigeration unit to be selectively used as a freezer or as a refrigerator or as a wine cooler.

SUMMARY OF THE INVENTION

An object of the present invention is to provide a new and improved thermostat control for use in a refrigeration unit.

Another object of the present invention is to provide a new and improved thermostat control that enables a temperature range to be selected from multiple temperature ranges for use in a single refrigeration compartment.

Another object of the present invention is to provide a control for a thermostat used for controlling the temperature in a refrigeration compartment of a refrigeration unit; the control enables a set-point temperature to be selected for the refrigeration compartment from a desired one of multiple temperature ranges and also prevents the inadvertent or accidental setting of the thermostat to a temperature outside of the desired temperature range.

Briefly, the present invention constitutes a new and improved thermostat control for use in controlling the operation of a temperature controlling thermostat in a refrigeration unit. The control includes a control dial for controlling the operation of a broad range thermostat so that one of a plurality of three temperature ranges may be selected as desired, thereby enabling the refrigeration unit to be operated either as a freezer or as a refrigerator or as a wine cooler. The control dial is divided into four segments respectively designated OFF, WINE COOLER, REFRIGERATOR and FREEZER. Stops are provided on the reverse side of the control dial at the high and low temperature settings for each temperature range. The cover of the thermostat is provided with a stop located at the indicator of the control dial so that the control dial may only be adjusted by an operator to a set-point temperature within the particular preselected temperature range.

The control dial is attached to the thermostat shaft to enable axial movement along the shaft between first and second axial positions. In the first axial position, the stops on the back of the control dial cooperatively interact with the stop on the thermostat cover to ensure that a set-point temperature is selected only within the chosen temperature range. When the control dial is moved to its second axial position, the stops on the back of the control dial are defeated in that they can pass over the stop on the cover of the thermostat to permit a different temperature range corresponding to a different mode of operation of the refrigeration unit to be selected. After a different temperature range and mode of operation have been selected, the control dial is returned to its first axial position so that it cannot be inadvertently or accidentally adjusted to a set-point temperature outside of the selected temperature range.

In this manner, a single refrigeration unit may be used in a desired one of a plurality of different modes, for example, as a freezer or as a refrigerator or as a wine cooler. In addition, the mode of operation of the refrigeration unit cannot be inadvertently or accidentally changed merely by adjusting the rotatable position of the control dial for the thermostat.

BRIEF DESCRIPTION OF THE DRAWING

The above and other objects, advantages and novel features of the present invention will become apparent from the following detailed description of the preferred embodiment of the present invention illustrated in the accompanying drawing wherein.

DESCRIPTION OF THE PREFERRED EMBODIMENT

Figure 2:
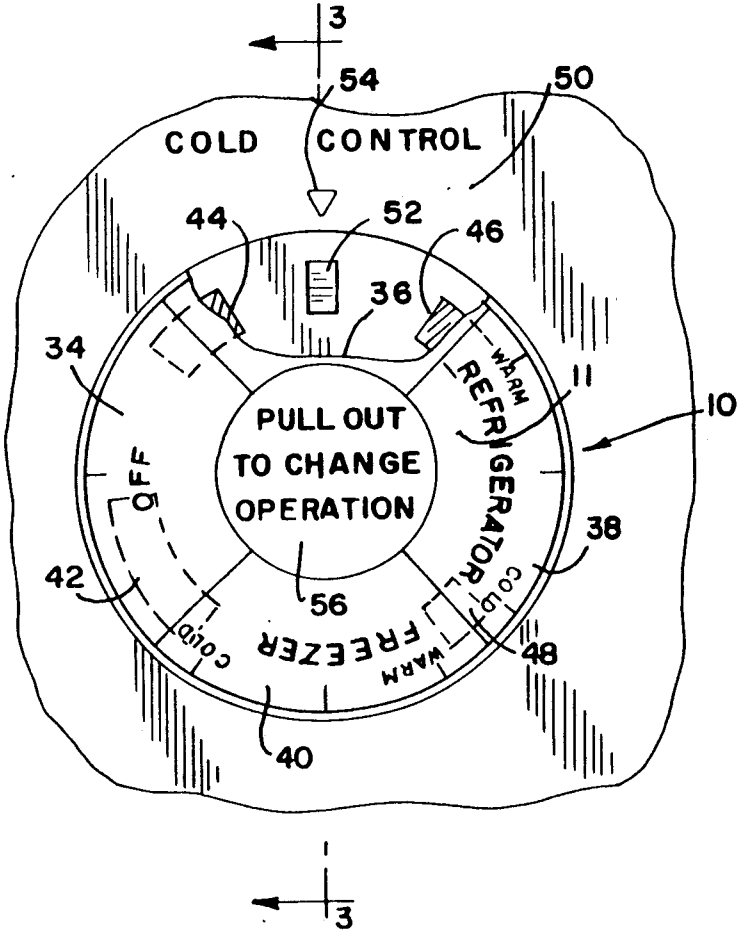
FIG. 2 is an enlarged fragmentary elevational view of the thermostat control of FIG. 1.
Figure 1:
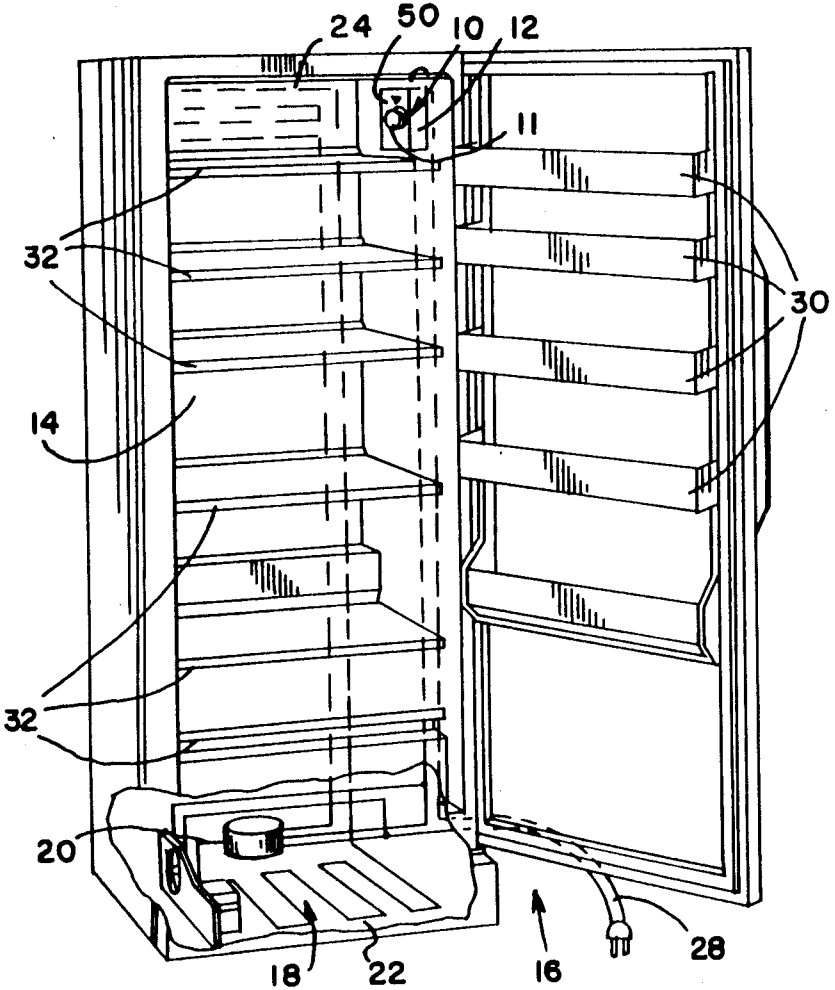
FIG. 1 depicts a thermostatically controlled refrigeration unit used in conjunction with a thermostat control constructed in accordance with the principles of the present invention.

Referring to the drawing and initially to FIGS. 1 and 2, there is illustrated a new and improved thermostat control 10 constructed in accordance with the principles of the present invention. The thermostat control 10 includes a control dial 11 and is used for controlling the operation of a broad range, temperature controlling thermostat 12. Preferably, the broad range thermostat 12 is used to control the temperature within a single refrigeration compartment 14 of a refrigeration unit 16. The broad range thermostat is conventional, per se, and may, in a specific embodiment, take the form of a gas filled thermostat available from several thermostat manufacturers, such as the Eaton Corporation. For example, the thermostat 12 may be capable of being set to a set-point temperature within the range of from approximately −20° F. to approximately +60° F.

The compartment 14 is cooled by a conventional sealed refrigeration system 18, for example, of the type described in U.S. Letters Pat. No. 4,555,915. The '915 patent is hereby incorporated herein by reference for all purposes The refrigeration system 18 conventionally includes a compressor 20, a condenser 22 and an evaporator 24. A circulating fan 26 is used to circulate cooling air over both the condenser 22 and the compressor 20. In addition, an evaporator fan (not illustrated) may also be used if desired. The thermostat 12 may be connected in series between an electrical power cable 28 and the refrigeration system 18 to control the operation of the refrigeration system 18 in a conventional manner, specifically, to maintain the temperature within the compartment 14 at a preset temperature.

In accordance with an important feature of the present invention, the refrigeration unit 16 may be used in one of a plurality of different operational modes as determined by the setting of the control dial 11 and of the thermostat 12. For example, the refrigeration unit 16 may be used as a wine cooler when the thermostat 12 is set to a set-point temperature in a relatively warm temperature range of from approximately +55° F. to approximately +60° F. Alternatively, the refrigeration unit 16 may be used as a standard refrigerator when the thermostat 12 is set to a set-point temperature in a cooler, second temperature range of from approximately +33° F. to approximately +40° F. Furthermore, the refrigeration unit 16 may be used as a freezer when the set-point temperature of the thermostat 12 is set to a set-point temperature in a relatively cold, third temperature range of from approximately −8° F. to approximately +5° F. In this manner, a single refrigeration unit 16 can be used in a desired one of multiple operational modes. In order to optimize the use of the refrigeration unit 16, a plurality of conventional, adjustable compartments 30 and conventional, adjustable shelves 32 may be appropriately positioned within the refrigeration unit 16 depending upon the particular operational mode selected for the unit 16.

In order to control the operational mode of the refrigeration unit 16 through the thermostat 12, the control dial 11 (FIG. 2) is divided into a plurality of four different zones 34, 36, 38 and 40. Each of the zones 34, 36, 38 and 40 occupies approximately one-fourth or a 90° segment of the control dial 11. As depicted in FIG. 2, the first zone 34 is used to maintain the refrigeration unit 16 in a deenergized or "OFF" condition. The second zone 36 is used to control the operation of the thermostat 12 when the refrigeration unit 16 is used as a conventional "WINE COOLER". The third zone 38 is used to control the operation of the thermostat 12 when the refrigeration unit 16 is used as a conventional "REFRIGERATOR." Furthermore, the fourth zone 40 is used to control the operation of the thermostat 12 when the refrigeration unit 16 is used as a conventional "FREEZER".

More specifically, the control dial 11 includes a plurality of stops or bosses 42, 44, 46 and 48, preferably fixedly secured to the reverse or inner side of the control dial 11. In a preferred embodiment, the stops 42, 44, 46 and 48 are formed as integrally molded portions of the control dial 11. A cover 50 of the thermostat 12 includes an outwardly projecting stop or boss 52 fixedly secured thereto and located adjacent to an indicator 54 for the control dial 11 that is used to indicate the set-point temperature selected for the refrigeration compartment 14.

In normal operation, when the refrigeration unit 16 is being used in a selected one of its operational modes, the stop 52 is located between an adjacent pair of the stops 42, 44, 46 and 48 so that a set-point temperature can be selected within the temperature range of operation of the preselected operational mode of the refrigeration unit 16. Thus, the most closely spaced apart surfaces of adjacent pairs of the stops 42, 44, 46 and 48 in cooperation with the stop 52 establish the high temperature and low temperature limits in each temperature range associated with each operational mode of the refrigeration unit 16. For example, as depicted in FIG. 2, the set-point temperature for the refrigeration unit 16 is set midway between the high temperature limit established by the stop 44 and the low temperature limit established by the stop 46 for the temperature range associated with the operation of the refrigeration unit 16 as a wine cooler, the operational mode associated with the zone 36 of the control dial 11. By grasping a centrally located, integrally molded, raised portion or knob 56, the control dial 11 can be rotated to a different set-point temperature for the refrigeration compartment 14 within the temperature range established by the high and low temperature limits associated with the stops 44 and 46. The control dial 11 also includes an integrally molded, polygonally-shaped, elongate mounting shaft 58 having an elongate, centrally disposed bore 60 formed therethrough for receiving a complementarily shaped rotatable control shaft 62 of the thermostat 12 for adjustably controlling the operational set-point of the thermostat 12.

In accordance with a further important feature of the present invention, the operational mode of the refrigeration unit 16 can be changed from a wine cooler (FIG. 2) to a refrigerator or a freezer in the following manner. Preferably, there is a very close or snug fit between the bore 60 and the shaft 62 so that the control dial 11 is not pivotably movable about the shaft 62 when the shaft 62 is fully received within the bore 60. Secured to the shaft 62 for movement therewith is a spring clip 64 having two, elongate, spaced apart, generally planar and parallel, cantilevered spring arms 66 and 68. The spring arm 66 includes at its outermost end an elongate, generally V-shaped retaining portion 70 for being releaseably received and retained within a complementarily shaped, elongate recess 72 of the control shaft 62 of the control dial 11. Preferably, the spring arm 68 is shorter in length than the spring arm 66 and also includes a generally V-shaped, elongate retaining portion 74 for receipt within and, under particular circumstances, for axial movement within an enlarged, elongate recess 76 formed on an opposite side of the polygonally-shaped mounting shaft 58 of the control dial 11. In this manner, the control dial 11 is releasably secured to the control shaft 62 of the thermostat 12 to ensure that the control shaft 62 is rotatably adjusted in conjunction with the rotatable adjustment of the control dial 11. The control dial 11 is shown in full operative engagement with the control shaft 62 of the thermostat 12 in FIG. 5. In this position, with the retaining portion 70 located in the recess 72 and with the retaining portion 74 located within the recess 76 at a first axial position along the shaft 58, any movement of the control dial 11 between the stops 44 and 46 (FIG. 2) results in an adjustment of the set-point of the thermostat 12 and a corresponding adjustment of the set-point temperature of the refrigeration compartment 14.

The operational mode of the refrigeration unit 16 may be changed by grasping the knob 56 and moving the control dial 11 axially outwardly with respect to and along the length of the control shaft 62. In doing so, the retaining portion 70 of the spring arm 66 is moved out of the recess 72 and, at the same time, the retaining portion 74 of the spring arm 68 is relocated at an opposite axial end of the recess 72, thereby functioning as a releasable stop to further axial movement of the control dial 11. In such an axial position, the stops 42, 44, 46 and 48 may be rotated and moved freely by the stop 52, thereby enabling a different operational mode to be selected for the refrigeration unit 16. Further axial outward movement of the control dial 11 would result in the movement of the retaining portion 74 out of the recess 76, thereby permitting the control dial 11 to be completely removed from the thermostat 12.

Figures 3, 4, 5, 6:
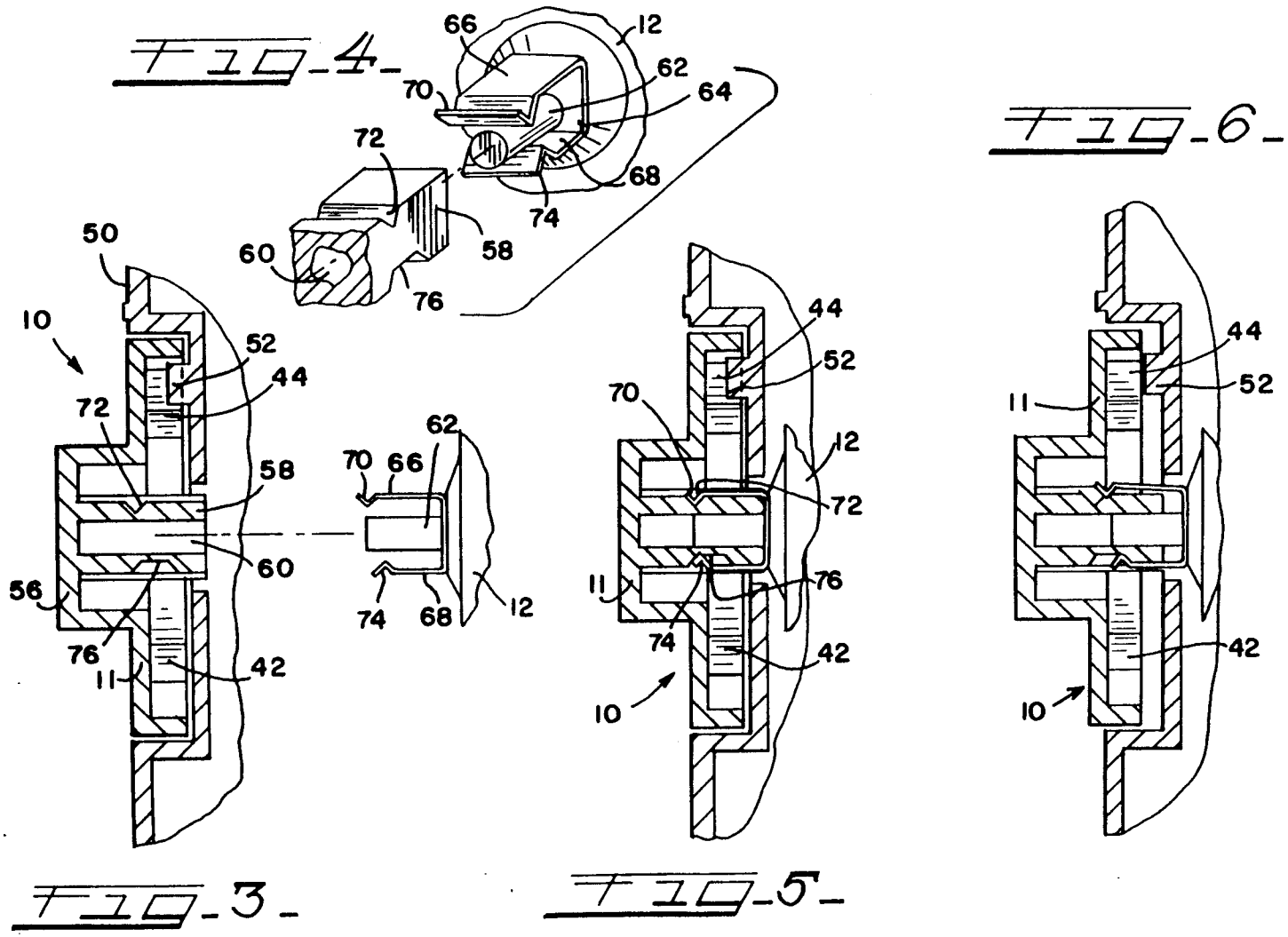
FIG. 3 is a fragmentary, exploded cross-sectional view of the thermostat control of FIG. 1 taken along line 3—3 of FIG. 2.
FIG. 4 is an enlarged, exploded perspective view of a portion of the thermostat control of FIG. 1.
FIG. 5 is an enlarged, cross-sectional view, similar to the view of FIG. 3, of a first axial position of a thermostat control dial along the shaft of the thermostat of FIG. 1.
FIG. 6 is an enlarged, cross-sectional view, similar to the views of FIGS. 3 and 5, of a second axial position of the thermostat control dial along the shaft of the thermostat of FIG. 1.

When the control dial 11 is axially moved to a position as indicated in FIG. 6, the operational mode of the refrigeration unit 16 can be set to function as a standard refrigerator by rotating the control dial 11 until the stop 52 is located between the stops 46 and 48, which, respectively, function as the high temperature and low temperature limits of the temperature range associated with the operation of the refrigeration unit 16 as a standard refrigerator. To prevent the unintentional or accidental adjustment of the temperature of the refrigeration compartment 14 outside of the temperature range associated with the operation of the refrigeration unit 16 as a standard refrigerator, once the stop 52 is aligned between the stops 46 and 48, the control dial 11 should be axially moved inwardly along the control shaft 62 so that the retaining portion 70 is once again received within the recess 72. With the control dial 11 in such an axial position, the interaction between the stop 52 and the stops 46 and 48 prevent the unintentional or accidental adjustment of the set-point temperature of the refrigeration compartment 14 to a temperature outside of the temperature range corresponding to the operation of the refrigeration unit 16 as a standard refrigerator.

In like manner, the operational mode of the refrigeration unit 16 can be adjusted to that of a freezer by rotating the control dial 11 until the stop 52 is disposed between the stops 42 and 48. Finally, the refrigeration unit 16 can be deenergized or shut off by disposing the stop 52 between the stops 42 and 44. It should be apparent that the particular configuration of the stops 42, 44, 46 and 48 is selected to exclude operation of the refrigeration compartment within certain portions of the overall broad range of the thermostat 12. Furthermore, the stops 42, 44, 46 and 48 prevent overlapping between the temperature ranges associated with the various operational modes of the refrigeration unit 16.

Obviously, many modifications and variations of the present invention are possible in light of the above teachings. For example, the configuration of the stops 42, 44, 46 and 48 can be adjusted as desired to exclude greater or lesser portions of the overall operational range of the thermostat 12. In addition, if desired, the stop 52 could be formed on the control dial 11 and the stops 42, 44, 46 and 48 could be formed on the cover 50 of the thermostat 12 without departing from the desired control of the operation of the refrigeration unit 16 in one of a plurality of operational modes. Furthermore, by varying the number and location of the stops 42, 44, 46 and 48, a greater or lesser number of temperature ranges for the refrigeration compartment 14 can be achieved and, therefore, a greater or lesser number of operational modes of the refrigeration unit 16 may be provided. Thus, it is to be understood that, within the scope of the appended claims, the invention may be practiced otherwise than as specifically described hereinabove.

What is claimed and desired to be secured by Letters Patent is:

1. A refrigeration unit comprising a refrigeration compartment, means for cooling said refrigeration compartment and means for controlling the operation of said cooling means to maintain a temperature in said compartment within a selected temperature range of a plurality of alternatively available, distinct temperature ranges respectively associated with a plurality of distinct operational modes of said refrigeration unit, said operational modes comprising at least two distinct operational modes of the following three distinct operational modes:

a wine cooler operational mode and a refrigerator operational mode and a freezer operational mode.

2. A refrigeration unit as recited in claim 1 wherein said plurality of distinct operational modes comprises said three distinct operational modes.

3. A refrigeration unit as recited in claim 1 wherein said controlling means comprises selector means for selecting said temperature and limit means for limiting said selector means to select said temperature within said selected temperature range.

4. A refrigeration unit as recited in claim 3 wherein said controlling means comprises a temperature controlling thermostat and wherein said selector means comprises a rotatable thermostat control dial and wherein said limit means comprises stop means for limiting the rotation of said control dial between a first limit position and a second limit position, respectively corresponding to the lower and upper temperature limits of said selected temperature range.

5. A refrigeration unit as recited in claim 4 wherein said stop means comprises first and second spaced apart stops formed on said control dial.

6. A refrigeration unit as recited in claim 5 wherein said stop means further comprises a third stop formed on said control dial spaced apart from both said first and second stops, said second and third spaced apart stops respectively corresponding to the lower and upper temperature limits of a second temperature range of said plurality of temperature ranges, said second temperature range being distinct from said selected temperature range.

7. A refrigeration unit as recited in claim 6 wherein said stop means further comprises a fourth stop formed on said control dial and spaced apart from said first, second and third stops, said third stop and said fourth stop respectively corresponding to the lower and upper temperature limits of a third temperature range of said plurality of temperature ranges distinct from both said selected and said second temperature ranges.

8. A refrigeration unit as recited in claim 4 further comprising means for defeating said limit means to enable said rotatable control dial to be rotated outside of said first and second limit positions and, thereby, to enable the selection of a second temperature range of said plurality of temperature ranges distinct from said selected temperature range and associated with a different operational mode of said refrigeration unit than the operational mode associated with said selected temperature range.

9. A refrigeration unit as recited in claim 8 wherein said control dial is axially movable between at least first and second axial positions, said stop means being enabled in said first axial position of said control dial to limit the rotation of said control dial and said stop means being defeated when said control dial is placed in said second axial position to enable rotational movement of said control dial beyond said first and said second limit positions.

10. A refrigeration unit as recited in claim 1 wherein said plurality of temperature ranges are non-overlapping temperature ranges.

11. A refrigeration unit comprising a refrigeration compartment, cooling means to cool said compartment and thermostatic control means for controlling said cooling means to maintain a selectable set-point temperature in said compartment, said control means comprising manually engageable selection means selectively positionable for establishing the set-point temperature within said compartment, first stop means for limiting the positioning of said selection means within a first predetermined range, second stop means for limiting the positioning of said selection means within a second predetermined range and means for disabling said first stop means to enable said selection means to be positioned within said second predetermined range and for disabling said second stop means to enable said selection means to be positioned within said first predetermined range, said refrigeration unit being adapted to be operated in a selected one of a plurality of different operational modes corresponding to a selected one of said first and second predetermined ranges.

12. A refrigeration unit as recited in claim 11 wherein said control means further comprises third stop means for limiting the movement of said selection means within a third predetermined range, said disabling means being selectively operable to disable said third stop means to enable said selection means to be positioned within a selected one of said first and second predetermined ranges.

13. A refrigeration unit as recited in claim 12 wherein said first predetermined range corresponds to the operation of said refrigeration unit as a wine cooler.

14. A refrigeration unit as recited in claim 13 wherein said second predetermined range corresponds to the operation of said refrigeration unit as a refrigerator.

15. A refrigeration unit as recited in claim 14 wherein said third predetermined range corresponds to the operation of said refrigeration unit as a freezer.

16. A refrigeration unit as recited in claim 12 wherein said first, second and third ranges are non-overlapping ranges.

17. A refrigeration unit comprising a refrigeration compartment, means for cooling said refrigeration compartment, and means for controlling the operation of said cooling means to enable said refrigeration unit to be selectively used as either a wine cooler or as a refrigerator or as a freezer, said controlling means comprises a temperature controlling thermostat having a rotatable control dial and an elongate control shaft configured to be received within said control dial, said control dial being axially movable along the length of said control shaft.

18. A refrigeration unit as recited in claim 17 wherein said controlling means further comprises first stop means for limiting the movement of said control dial when disposed in a first axial position to a first range between first and second limit positions, said first range corresponding to a first temperature range associated with the operation of said refrigeration unit as a wine cooler.

19. A refrigeration unit as recited in claim 18 wherein said controlling means further comprises second stop means for limiting the movement of said control dial when disposed in said first axial position to a second range between third and fourth limit positions, said second range being distinct from and non-overlapping with said first range and corresponding to a second temperature range associated with the operation of said refrigeration unit as a refrigerator.

20. A refrigeration unit as recited in claim 19 wherein said controlling means further comprises a third stop means for limiting the movement of said control dial when disposed in said first axial position to a third range between fifth and sixth limit positions, said third range being distinct from and non-overlapping with both said first and second ranges and corresponding to a third temperature range associated with the operation of said refrigeration unit as a freezer.

21. A refrigeration unit as recited in claim 20 wherein said controlling means further comprises means for defeating said first, second and third stop means by axially moving said control dial to a second axial position spaced from said first axial position, after which an operational mode of said refrigeration unit may be selected by repositioning said control dial to said first axial position for rotational movement within a desired range of said first, second and third ranges corresponding to the selected operational mode of said refrigeration unit.

22. A thermostat control for controlling the set-point temperature within a refrigeration compartment comprising means for selecting said set-point temperature, said selecting means comprising a rotatable control dial, stop means for limiting the rotational movement of said control dial, said stop means comprising first, second, third, fourth and fifth stops, said first stop being movable with respect to each of said second, third, fourth and fifth stops, said second, third, fourth and fifth stops being fixedly secured to said control dial and being spaced apart to form a first temperature range between said second and third stops corresponding to the operation of said refrigeration compartment as a wine cooler and to form a second temperature range between third and fourth stops corresponding to the operation of said refrigeration compartment as a refrigerator and to form a third temperature range between said fourth and fifth stops corresponding to the operation of said refrigeration compartment as a freezer and means for defeating said first, second, third, fourth and fifth stop means to enable said first stop means to be selectively positioned between any pair of adjacent second, third, fourth and fifth stop means and, thereby, for enabling the operation of said refrigeration compartment in a selected operational mode.

23. A thermostat control for controlling the set-point temperature within a refrigeration compartment as recited in claim 22 wherein said first, second and third temperature ranges are non-overlapping temperature ranges.

24. A thermostat control for controlling the set-point temperature within a refrigeration compartment as recited in claim 22 wherein said control dial is axially movable between a first axial position in which said first stop is disposed between a selected adjacent pair of said first, second, third and fourth stops and a second axial position in which said first, second, third, fourth and fifth stops are defeated so as to enable the rotational movement of said second, third, fourth and fifth stops past said first stop.

25. A thermostat control for controlling the set-point temperature within a refrigeration compartment as recited in claim 24 further comprising spring means for releasably retaining said control dial in at least one of said first and second axial positions.

26. A refrigeration unit comprising a refrigeration compartment, means for cooling said refrigeration compartment, and means for controlling the operation of said cooling means to enable said refrigeration unit to be selectively alternatively used to maintain the temperature of items in said refrigeration compartment in accordance with at least two distinct operational modes of at least the following three distinct operational modes: a wine cooler operational mode and a refrigerator operational mode and a freezer operational mode, said controlling means comprises a temperature controlling thermostat having a rotatable control dial and an elongate control shaft configured to be received within said control dial, said control dial being axially movable along the length of said control shaft.

27. A refrigeration unit as recited in claim 26 wherein said controlling means further comprises first stop means for limiting the movement of said control dial when disposed in a first axial position to a first range between first and second limit positions, said first range corresponding to a first temperature range associated with the operation of said refrigeration unit as a wine cooler.

28. A refrigeration unit as recited in claim 27 wherein said controlling means further comprises second stop means for limiting the movement of said control dial when disposed in said first axial position to a second range between third and fourth limit positions, said second range being distinct from and non-overlapping with said first range and corresponding to a second temperature range associated with the operation of said refrigeration unit as a refrigerator.

29. A refrigeration unit as recited in claim 28 wherein said controlling means further comprises a third stop means for limiting the movement of said control dial when disposed in said first axial position to a third range between fifth and sixth limit positions, said third range being distinct from and non-overlapping with both said first and second ranges and corresponding to a third temperature range associated with the operation of said refrigeration unit as a freezer.

30. A refrigeration unit as recited in claim 29 wherein said controlling means further comprises means for defeating said first, second and third stop means by axially moving said control dial to a second axial position spaced from said first axial position, after which an operational mode of said refrigeration unit may be selected by repositioning said control dial to said first axial position for rotational movement within a desired range of said first, second and third ranges corresponding to the selected operational mode of said refrigeration unit.

31. A refrigeration unit comprising a refrigeration compartment, means for cooling said refrigeration compartment and means for controlling the operation of said cooling means to enable said refrigeration unit to be selectively alternatively used to maintain the temperature of items in said refrigeration compartment in accordance with at least two distinct operational modes of at least the following three distinct operational modes: a wine cooler operational mode and a refrigerator operational mode and a freezer operational mode, said cooling means is controlled by said controlling means selectively to maintain the temperature of said refrigeration compartment at a temperature within one temperature range of a plurality of at least two distinct, non-overlapping temperature ranges respectively corresponding to said at least two distinct operation modes.

* * * * *